US007028749B2

(12) United States Patent
Liang et al.

(10) Patent No.: US 7,028,749 B2
(45) Date of Patent: Apr. 18, 2006

(54) TWIN ROLL CASTING OF MAGNESIUM AND MAGNESIUM ALLOYS

(75) Inventors: Daniel Dong Liang, Rowville (AU); Wendy Borbidge, Hawthorn (AU); Daniel Raymond East, Carlton North (AU); Ross Victor Allen, East Bentleigh (AU)

(73) Assignee: Commonwealth Scientific and Industrial Research Organisation, Campbell (AU)

( * ) Notice: Subject to any disclaimer, the term of this patent is extended or adjusted under 35 U.S.C. 154(b) by 0 days.

(21) Appl. No.: 11/068,514

(22) Filed: Feb. 28, 2005

(65) Prior Publication Data

US 2005/0236135 A1 Oct. 27, 2005

Related U.S. Application Data

(63) Continuation of application No. PCT/AU2003/001097, filed on Aug. 27, 2003.

(30) Foreign Application Priority Data

Aug. 29, 2002 (AU) ..... 2002951075

(51) Int. Cl.
*B22D 11/22* (2006.01)

(52) U.S. Cl. ..... 164/455; 164/480

(58) Field of Classification Search ..... 164/455, 164/475, 480, 489, 490, 428
See application file for complete search history.

(56) References Cited

U.S. PATENT DOCUMENTS 5,439,047 A * 8/1995 Eckert ..... 164/471
6,596,671 B1 * 7/2003 Whitney et al. ..... 508/103

FOREIGN PATENT DOCUMENTS

JP 1-202345 8/1989
JP 10-102178 4/1998
WO 03/027345 A 4/2003

OTHER PUBLICATIONS

Patent Abstracts of Japan of JP 1202345 A (Kobe Steel KK), Aug. 15, 1989.
Patent Abstracts of Japan of JP 10102178 A (Kawasaki Steel Corp), Apr. 21, 1998.

* cited by examiner

*Primary Examiner*—Len Tran
(74) *Attorney, Agent, or Firm*—Ladas and Parry LLP

(57) ABSTRACT

A process for the production of magnesium alloy strip, by twin roll casting, includes the steps of passing molten alloy from a source of supply to a feeding device; feeding the alloy from the feeding device through an elongate outlet of a nozzle and a pair of substantially parallel rolls spaced to define a bite therebetween; rotating said rolls whereby alloy is drawn from the chamber through the bite; and flowing coolant fluid through each roll and thereby cool alloy received in the chamber by heat energy extraction by the rolls whereby substantially complete solidification of the alloy is achieved in the chamber prior to alloy passing through the bite as hot rolled alloy strip. Alloy is held at the source at a temperature sufficient to maintain alloy in the feed device at a superheated temperature; a depth of molten alloy is maintained in the feed device at from about 5 mm to about 22 mm above a centerline of the bite in a plane containing the axes of the rolls; and heat energy extraction by the cooled rolls is maintained at a level sufficient to maintain alloy strip issuing from the bite at a surface temperature below about 400° C.; whereby the hot rolled alloy strip is substantially free of cracks and has good surface quality.

24 Claims, 7 Drawing Sheets

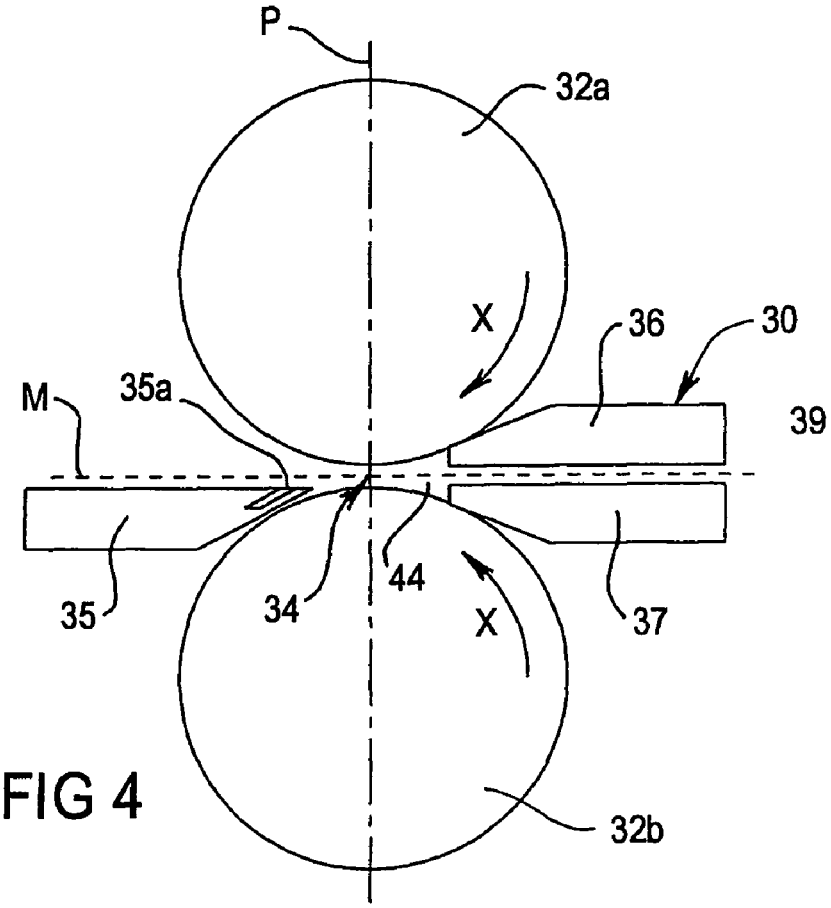
FIG 4
FIG 5
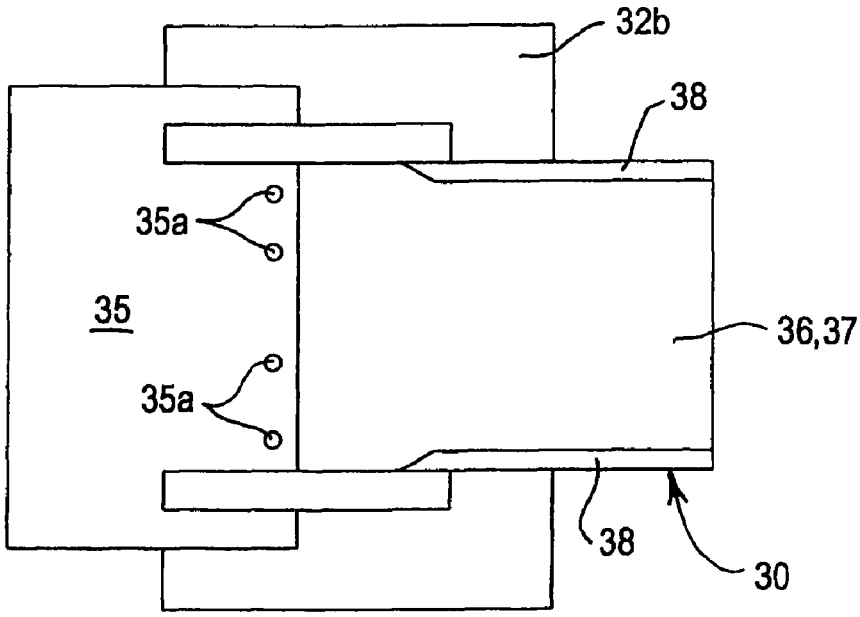

TWIN ROLL CASTING OF MAGNESIUM AND MAGNESIUM ALLOYS

This is a continuation of International Application PCT/AU2003/001097 filed on Aug. 27, 2003, which designated the U.S., claims the benefit thereof and incorporates the same by reference.

This invention relates to twin roll casting of magnesium and magnesium alloys (herein generally referred to collectively as "magnesium alloy").

The concept of twin roll casting of metals is old, dating back at least to inventions by Henry Bessemer in the mid-1900's. However, it was not until about 100 years later that interest in possible commercial use of twin roll casting began to be investigated. The concept as proposed by Bessemer was based on the production of strip using a metal-feeding system in which molten metal was fed upwardly through a bite defined between two laterally spaced, parallel rolls. More recent proposals were based on a downwards feed of molten metal to the rolls. However it has become accepted that the preferred arrangement is with the rolls spaced vertically, rather than horizontally as in those earlier proposals, with the alloy feed being substantially horizontal. While the rolls are spaced vertically, their axes preferably are in a plane which is inclined at a small angle of up to about 15° to the vertical. With this inclination, the lower roller is displaced downstream, relative to the upper roller, with respect to the direction of alloy feed to and beyond the bite.

While there has been some commercial use of twin roll casting, this has been limited in its extent. It also has been limited in the range of alloys to which it is applied, since use essentially has been restricted to suitable aluminium alloys. To this stage, there has been limited success in establishing a suitable process for twin roll casting of magnesium alloys.

In achieving a practical process for successfully twin roll casting of magnesium alloys, such as on a substantially continuous or a semi-continuous basis, there are several problems which need to be overcome. A first of these is that magnesium alloy melts tend to oxidise and catch fire, while moisture from any source presents a potential risk of explosion. There are established procedures based on use of a suitable flux or a suitable atmosphere to prevent oxidation and risk of fire, while moisture is able to be excluded. Also, magnesium and some magnesium alloys that do not contain or have only low additions of beryllium, such as AZ31, can have a high tendency to oxidise in the melt state, such that conventional flux or the atmosphere control is not adequate during the twin roll casting operation. However, overcoming these problems adds to the complexity of processes for twin roll casting such that the complexity is a problem.

A further problem is that magnesium alloys have a thermal capacity such that, relative to aluminium alloys, they tend to freeze quickly. Also, again relative to aluminium alloys, some magnesium alloys such as AM60 and AZ91 have a considerably larger freezing range, or temperature gap between the solidus and liquidus temperatures. The range or gap may be about 70 to 100° C. or higher for magnesium alloys, compared with about 10 to 20° C. for many aluminium alloys. The large freezing range or gap gives rise to surface defects and internal segregation defects in twin roll cast sheet in the as-cast condition.

Importantly, there is the problem of the continuous requirement to reduce operating costs, including costs for consumables and casting preparation and thereby make twin roll casting more competitive with alternative technology, more flexible for both short operating periods (e.g. one day) and long operating periods (e.g. weeks), and enable its range of application to be extended. This is a general problem for twin roll casting technology, but is more severe for the casting of magnesium alloys in view of other problems discussed above. Also, there is a problem in extending twin roll casting technology in order to enhance the physical properties of strip material produced. While this also is a general problem for the technology, it is particularly acute in the case of magnesium alloys due to problems in producing substantially crack-free strip which has good surface quality and is substantially free of internal segregation defects.

The present invention is directed to providing a process for the twin roll casting of magnesium and magnesium alloys which, at least in preferred forms, enables one or more of the above problems to be ameliorated.

The present invention is directed to providing an improved process for twin roll casting of magnesium alloys, to produce magnesium alloy strip of a required thickness and width. The process of the invention enables the width of the strip to be up to and beyond about 300 mm, such as up to about 1800 mm, as required. In general, the thickness of the strip can range from about 1 mm or less, up to about 15 mm, but preferably the thickness is from about 3 mm to about 8 mm.

The process of the present invention provides for the casting of magnesium alloy by supplying molten alloy to a chamber formed between a nozzle and a pair of oppositely rotating, substantially parallel rolls which are internally fluid cooled and which are spaced generally one above the other to define a bite there between. The process includes introducing molten magnesium alloy through the nozzle, and cooling the magnesium alloy by heat energy extraction therefrom by the cooled rolls whereby substantially complete solidification of the magnesium alloy is achieved in the chamber, prior to the magnesium alloy passing through the bite defined between the rolls.

These general features of the process of the present invention are the same as those required for twin roll casting of aluminium alloys. However, this essentially is the extent of similarity between respective processes for magnesium alloys and for aluminium alloys. Indeed despite the indicated similarity, the process for casting of aluminium alloys provides little if any guidance as to a process suitable for magnesium alloys. Also, to the extent that twin roll casting has been attempted with other alloys, these are found to necessitate processes which are similar to that required for aluminium alloys and which also provide little if any guidance as to a process suitable for magnesium alloys.

Thus, according to the invention, there is provides a process for the production of magnesium alloy strip, by twin roll casting, wherein the process includes the steps of:

(a) passing molten alloy from a source of supply to a feeding device;

(b) feeding molten alloy from the feeding device through a nozzle to a chamber formed between an elongate outlet of the nozzle and a pair of substantially parallel rolls which are spaced one above the other to define a bite therebetween;

(c) rotating said rolls in opposite directions whereby alloy is drawn from the chamber through the bite simultaneously with the feeding of step (b); and (d) flowing coolant fluid through each roll during the rotating step (c) to provide internal cooling of the rolls and thereby cooling alloy received in the chamber by heat energy extraction by the cooled rolls whereby substantially complete solidification of the magnesium alloy is achieved in the chamber prior to alloy passing through the bite defined between rolls and issuing therefrom as hot rolled alloy strip;

and wherein the process further includes:

maintaining alloy held at the source at a temperature sufficient to maintain alloy in the feed device at a superheated temperature above its liquidus temperature for the alloy;

maintaining a depth of molten alloy in the feed device at a sufficient, controlled substantially constant height of molten alloy above a centreline of the bite in a plane containing the axes of the rolls; and maintaining heat energy extraction by the cooled rolls in step (c) at a level sufficient to maintain alloy strip issuing from the bite at a surface temperature below about 400° C.;

whereby the hot rolled alloy strip is substantially free of cracks and has good surface quality.

In the process of the invention, the magnesium alloy may be supplied to an inlet end of the nozzle, for flow therethrough to enter the chamber through an outlet end of the nozzle, from a feed device comprising a tundish to which the alloy is supplied from a suitable source of molten alloy. However, a float box or other alternative form of feed device can be used in place of a tundish. It is required that the feed device provides a controlled, substantially constant melt head for the molten magnesium alloy. That is, molten alloy in the tundish, float box or the like is required to be maintained at a depth such that the surface of the molten alloy therein is at a controlled, substantially constant height (or melt head) above the intersection between a horizontally extending central plane of the nozzle and a plane containing the axes of the rolls. Relative to that intersection, which substantially corresponds to the centre line of the bite of the rolls in that plane, the melt head for casting magnesium alloy of the above-indicated strip thickness provided by the invention, preferably is from 5 mm to 22 mm. The melt head may be from 5 mm to 10 mm for magnesium and magnesium alloys with lower levels of alloy element addition, such as commercial pure magnesium and AZ31, and from 7 mm to 22 mm for magnesium alloys with higher levels of alloy element addition, such as AM60 and AZ91.

The melt head of 5 to 22 mm required by the present invention is in marked contrast to requirements for twin roll casting of aluminium alloys. In the latter case, the melt head generally is kept to a minimum of about 0 to 1 mm. This difference, significant in itself, is inter-related with a number of other important differences, as will become apparent from the following description.

In the process of the invention, the magnesium alloy supplied to the tundish or other feed device is superheated above its liquidus temperature. The extent of superheating may be to a temperature of from about 15° C. to about 60° C. above the liquidus temperature. In general, the lower end of this range, such as from 15° C. to about 35° C., preferably from about 20° C. to 25° C., is more appropriate for magnesium and alloys with lower levels of alloy element additions. For alloys with higher levels of alloy element additions, the upper end of the range, from about 35° C. to about 50° C. to 60° C., generally is more appropriate.

The extent of superheating necessary in twin roll casting of magnesium alloys is similar to that required for aluminium alloys. With twin roll casting of aluminium alloys, superheating is to a level of about 20° C. to 60° C., usually about 40° C., above the alloy liquidus, compared to the 15° C. to 35° C. for magnesium alloys with lower levels of additions or 35° C. up to 50° C. to 60° C. for magnesium alloys with higher levels of additions required for the invention. Despite this similarity, there are important fundamental dissimilarities between the two distinct aluminium and magnesium alloy types. An important dissimilarity between the aluminium alloys and magnesium alloys, particularly magnesium alloys with higher levels of alloy element addition, is indicated by the respective temperature gap between liquidus and solidus temperatures. Thus, whereas aluminium alloys usually have a liquidus/solidus temperature gap of about 10° C. to 20° C., that gap for at least magnesium alloys with higher levels of alloy element addition is more usually from about 70° C. to 100° C., but can be substantially in excess of that range. Even where the freezing ranges for aluminium alloys and the magnesium alloys are similar, such as with magnesium alloys with lower levels of alloy element addition, the magnesium alloys have much better castability than aluminium alloys.

In the twin roll casting of magnesium alloys with higher levels of alloy element addition, full solidification of the molten alloy must be controlled to be within a relatively narrow region between the outlet of the nozzle and the bite of the rolls. In view of this, it is surprising that significant superheating above the alloy liquidus is appropriate. It will be appreciated that such superheating significantly increases the quantity of heat energy which needs to be extracted from the molten alloy in order to achieve full solidification of the alloy. As also will be appreciated, the relatively wide liquidus/solidus temperature gap of magnesium alloys, such as with higher levels of alloy element addition, also makes full solidification control difficult to attain. However, in general, the required control is able to be achieved where the casting is conducted under conditions providing for alloy strip exiting from the rolls to have a surface temperature within a required range. In particular, it is necessary that alloy strip exits from the rolls with a surface temperature below about 400° C.

With twin roll casting of magnesium alloys, full solidification of the molten alloy again must be controlled to be within a relatively narrow region between the outlet of the nozzle and the bite of the rolls. The zone is not as narrow for alloys with lower levels of alloy element addition as it is for alloy with a high level of alloy element addition. Despite this and the lower level of superheating appropriate for alloys with the low levels of alloy element addition, the level of superheating these alloys again is surprising, even if more acceptable, given the narrower freezing range applicable. Again, the required control is able to be achieved where the casting is conducted under conditions providing for strip exiting from the rolls to have a surface temperature below about 400° C. However, the temperature preferably is substantially below 400° C., such as from about 180° C. to about 300° C., for alloys with low levels of alloy element addition.

As indicated above, a strip surface temperature of below about 400° C. is necessary. However, the extent to which it is desirable for the temperature to be below that level varies with the level of alloy element addition. For magnesium alloys with higher levels of alloy element addition, a surface temperature of from about 300° C. to 400° C. alloy strip exiting from the rolls is necessary to enable the production of crack-free strip with good surface finish. For alloy with a lower level of alloy element addition, a lower surface temperature ranging from 300° C. down to about 180° is necessary for production of crack-free strip of good surface finish.

At progressively higher temperatures, the likelihood of cracks, surface defects and ultimately hot spots, increases. However, attaining such temperatures in strip exiting from the rolls necessitates a very high level of heat energy extraction, particularly with alloy having lower levels of alloy element addition. As will be appreciated, the heat energy extraction needs to be such as to allow for the heat energy due to superheating, the level of heat energy necessary to bridge the temperature gap between the liquid and solidus for the alloy, and the need to reach a surface temperature substantially below the solidus temperature. However, the surface temperature to be attained in the overall range of 180° C. to 400° C. depends on the solidus temperature for a given alloy. It also can decrease with increasing strip thickness since the surface temperature is to be such as to give rise to a suitable temperature below the solidus at the centre of the strip.

The indicated upper limit of 400° C. for strip surface temperature is at a level which is from about 40° C. to 190° C. below the solidus temperatures for magnesium casting alloys. To ensure that the temperature at the centre of the strip is at a suitable level, the surface temperature preferably is not less than about 85° C. below the solidus temperature for a given alloy. The need for this is not simply to ensure that the strip has solidified throughout. Rather, it is to ensure that throughout its thickness the alloy strip has sufficient strength to enable its production without cracking or surface defects, under the specific load necessarily applied to the rolls.

The need to attain a surface temperature in the indicated range below 400° C., in the production of magnesium alloy strip is a feature distinguishing the process of the invention from a process for producing aluminium alloy strip. With the aluminium alloys, it is necessary only that the strip has solidified throughout its thickness, such that the centre of the strip is able to be just below the solidus temperature. Under such conditions, the aluminium alloy strip has sufficient strength to enable it to be hot rolled. However, with magnesium alloy strip, it is necessary that substantially the full thickness is sufficiently below the solidus temperature in order that the strip can be subjected to hot rolling.

The level of the specific load is a further feature by which the present invention differs significantly from a process for production of strip of aluminium alloy. The specific load applied to the rolls in the process of the present invention for magnesium alloys is from about 2 kg to about 500 kg per mm of roll length. The range preferably is from 100 to 500 kg/mm. However, the range can be as low as about 2 to about 20 kg/mm and hence the specific load in the process of the present invention can be more than an order of magnitude lower than the specific loads used in producing aluminium alloy strip by twin roll casting. For aluminium alloys, a specific load of from about 300 to about 1200 kg/mm is usual. In each case, there is resultant hot rolling of the alloy moving to and passing through the bite of the rolls. The level of specific load used for aluminium alloys results in hot rolling giving rise to a thickness reduction of from about 20% to about 25%. In contrast, the specific load required for the present invention results in a thickness reduction of from about 4% to about 9% in magnesium alloy strip being produced.

As with the alloy strip surface temperature range of 180° C. to 400° C., the level of applied load and resultant thickness reduction are to facilitate production of magnesium alloy strip which is substantially free of cracks and has good surface quality. At higher levels of applied load and thickness reduction, production of strip which is substantially free of cracks is more difficult to achieve, while surface defects also become more likely to arise.

To allow for the liquidus/solidus gap and also to avoid segregation, it is necessary that heat energy extraction from the molten and solidifying magnesium alloy of proceeds relatively rapidly. Alloy contacting the surface of each roll drops rapidly in temperature to below the solidus but, as solidification proceeds through to the centre of strip being formed, cooling is less rapid. As the strip being formed is advancing towards the bite between the rolls, lines in longitudinal sections through the thickness of the strip showing alloy at the liquidus temperature have V-shape form, pointing in the direction of strip advance and extending from points at which the alloy contacts each roll. Lines in those sections showing alloy at the solidus temperature also have a V-shape form, pointing in that direction and extending from those contact points, but with the arms of the V-shape having a larger included angle. Thus, the temperature gap between those lines for alloy at the liquidus and the solidus, increases in the direction of travel with distance from each roll surface to the centre of the forming strip. It is required that the increase in this gap be kept to a minimum. In general, it is found that this is achieved if the strip exhibiting from the bite of the rolls has a surface temperature below about 400° C., such as within the range of from 300° C. to 400° C.

In the chamber formed between nozzle and the rolls, cross-sections parallel to a plane through the axes of the rolls decrease in area, through to a minimum at the bite between the rolls, due to the curved surfaces of the rolls. The distance from the nozzle outlet to that plane is referred to as the "set-back". In its flow over the distance of the set-back, molten magnesium alloy issuing from the outlet travels a short initial part of the set-back distance before making contact with the rolls. The contact with each roll is along a longitudinal line on its surface. The distance from the outlet to the respective contact line of each roll is dependent upon the width of lips of the nozzle defining the outlet, the closeness of fitting of the nozzle between the rolls and the diameter of the rolls. In the process of the invention the set-back, which also varies with the diameter of the rolls, may be in the range of about 12 mm to about 17 mm for rolls having a diameter of about 185 mm. The set-back increases or decreases with increase or decrease in the diameter of the rolls and, for example, for rolls having a diameter of about 255 mm, the set-back most preferably is from about 28 to about 33 mm, such as about 30 mm.

The initial part of the set-back, from the outlet of the nozzle to the above-mentioned line at which the alloy makes contact with the surface of each roll, is lo dependent upon the diameter of the rolls and the set-back. However, the initial part of the set-back most preferably is such that factors including the surface tension of the magnesium alloy and the melt head are able to maintain a convex meniscus at each of the upper and lower molten metal surface over the length of that initial part. Depending on the thickness of strip to be produced, that initial part may be up to 35%, such as from about 10% to 30% of the set-back, with solidification of alloy to be achieved in the remainder of that length and in advance of the bite of the rolls. From the lines of contact the convex meniscus of alloy makes with the rolls, full solidification of the alloy between upper and lower surfaces preferably proceeds in advance of the final 5% to 15% of the set-back which immediately precedes the bite of the rolls. Thus, full solidification of the alloy throughout the thickness of strip being formed may need to be achieved in not more than about 50% of the set-back distance. However, some cooling from the superheat temperature will occur in the nozzle and in the initial part of the set-back.

The features of the present invention for twin roll casting of magnesium alloys enable a practical benefit relative to standard practices in relation to aluminium alloys. This is in relation to start-up for commencement of a casting cycle. The procedures enabled by the present invention enable start-up in not more than a few minutes, such as from 0.5 up to 3 to 5 minutes for the invention compared with up to 50 minutes for standard practices for aluminium alloys.

In the standard practices for twin roll casting of aluminium alloys, there is used either a lay-off or a hard-sheet start-up. In a lay-off start-up, the rolls are rotated substantially in excess of production speed, such as by 40%, when a casting cycle commences. The molten alloy is unable to fill the chamber defined between the nozzle and the rolls at the higher roll speed. Thus, only broken sheet, which is thinner and narrower than required is produced, although the width progressively increases. When full width is achieved, the roll speed is gradually reduced, enabling the thickness of the sheet to increase progressively. Eventually, the chamber is full and stable operation at production roll speed is established.

For the hard-sheet start-up, roll speed initially is substantially lower, such as by 40%, than production speed. The lower speed enables filling of the chamber defined by the nozzle and the rolls, and quick commencement of production of "hard sheet" of full thickness and width. Gradually the roll speed is increased to attain stable operation at production roll speed.

The substantial period of time necessary to attain production roll speed with each of these forms of standard practice for twin roll casting of aluminium alloys obviates the need for effective and efficient temperature stabilization. Thus, production start-up is by superheated molten alloy being supplied to a tundish, for flow from the latter to the nozzle. Heating of the tundish and nozzle by incoming alloy is gradual and it necessarily takes a substantial period to attain equilibrium operating temperatures throughout the casting apparatus.

In the present invention, it is found that equilibrium operating temperatures are able to be attained efficiently, in a short period of time, by preheating the tundish, or other feed device, and the nozzle. For this, hot air preferably is blown into and through the tundish, and then through the nozzle so as to exit from the nozzle outlet. The hot air is at a temperature sufficient to heat the tundish quickly to close to its required operating temperature, and may be from about 500° C. to 655° C., such as from 550° C. to 600° C. In the short time for this to be achieved, the nozzle is heated to a sufficient temperature ranging down to about 200° C. to 400° C. along the nozzle outlet. Where, for example, the nozzle has internal guide members for directing alloy to each end of the outlet, to achieve uniform alloy flow along the length of the outlet, the nozzle temperature may be about 400° C. at each end of the outlet and, due to hot air being impeded by the guide members, about 200° C. at a central region of the outlet.

The preheating used in the process of the present invention enables equilibrium operating temperatures to be established in not more than a few minutes, such as about 3 to 5 minutes. Thus, the lay-off procedure gives rise to a substantial risk of molten alloy not being solidified before passing through the bite of the rolls such that, with magnesium alloys, there is a substantial fire risk. Also, while the hard-sheet procedure more readily ensures that all alloy is solidified before passing through the rolls, there is a fire-risk arising from there being an increased possibility of molten alloy flooding from the chamber, between the nozzle and the rolls. The present invention obviates the need for either of these protracted start-up procedures used for twin roll casting of aluminium alloys, since the short time required for temperature equilibrium to be obtained enables start-up with close to full operational roll speed. Thus, the output of full thickness, full width sheet or strip is able to be quickly established.

In the course of twin roll casting, in accordance with the present invention, it is found that there can be considerable temperature variation across the width of strip or sheet exiting from the bite or gap of the rolls. The variation is such that a central region of the strip is hotter than edge regions. The variation in temperature can be up to about 70° C., and generally is in excess of about 20° C. The temperature variation can introduce a surface defect referred to as hot-line, and/or can result in the strip twisting due to thermal stress. Similar temperature variation and consequences can be encountered in alloys other than magnesium alloys.

We have found that the temperature variation can at least be reduced by use of a modified form of nozzle. The modified nozzle has a top plate and a bottom plate, with the lateral extent of the outlet of the nozzle being defined by a respective edge of each of the plates. Over a central region of at least one of the plates, that edge is set back relative to end regions of the edge. The central region of the edge has a length and location corresponding to the central region of strip or sheet to be cast. While a central region of each plate may be set back, it is preferred that only the top plate has such set back central region.

The set-back preferably is substantially uniform across the central region, although the set-back may be of concave arcuate form. The set-back preferably is less than about 7 mm, such as from 2 to 4 mm. With such set-back aligned with a region of the strip at which a relatively higher temperature would prevail but for the set-back, the temperature difference across the width of the strip is able to be substantially reduced or eliminated. Thus, hotline is reduced or prevented, while twisting of the strip is reduced or prevented.

It is indicated above that, with the twin roll casting of magnesium alloys, there are several problems which need to be overcome. The first of these is the risk of oxidation and fire. The present invention does not obviate the need for use of the established procedures based on the use of a suitable flux and atmosphere. However it does enable this risk to be still further reduced. Thus, the efficient start-up procedures enabled by the present invention substantially avoids the risk of fire from molten alloy not being solidified full before passing through the rolls or from molten alloy flooding from the chamber between the nozzle and the rolls. Also, the low roll load of about 2 to 500 kg/mm and corresponding low level of rolling reduction, combined with limited superheating and rapid solidification in advance of the bite between the rolls, further reduce the risk of molten alloy passing through the bite and being exposed to the atmosphere by cracking or surface defects.

As indicated, the invention does not obviate the need for use of a suitable atmosphere to control fire risk. However, an important preferred form of the invention provides an improvement on established procedures. In relation to fire risk control, it is common practice to use a mixture of sulphur hexafluoride in dry air. The $SF_6$/dry air mix is not suitable for magnesium alloys high in aluminium, while it is not always reliable at start-up or at the end of a casting run. In each case, we have found that substantial improvement is possible by adding to the mixture a few percent, such as from about 2 to 6 volume %, of a hydrofluorocarbon. The compound 1,1,1,2-tetrafluoroethane, referred to by the designation HFC-134a, is particularly preferred. However, other gases can be used with or without $SF_6$/HFC-134a.

During a casting operation, a protective atmosphere of $SF_6$/dry air or other suitable atmosphere is maintained to protect against the risk of a fire. Where the alloy being cast is one for which that mixture provides limited protection, the mixture as supplied also contains the hydrofluorocarbon, preferably HFC-134a. This significantly improves the protection against fire risk. However, for alloys for which the $SF_6$/dry air mixture generally is effective, it generally is necessary to add the hydrofluorocarbon for a short period at start up and at termination of a casting operation.

The problem of premature freezing is substantially overcome by the rapid establishment of equilibrium operating temperatures and high speed, assisted by the good castability of magnesium alloys. Significant factors enabling this are preheating such as described above, and quick attainment of roll speed and, hence, other operating conditions.

Difficulties arising from wide freezing range of magnesium alloys with high levels of additions are addressed by features of the present invention which also facilitate the enhancement of the physical properties of magnesium alloy strip produced by the invention. There is a number of inter-related features which are relevant to these matters.

With aluminium alloys, rapid solidification is able to be achieved by the good contact quality between the molten alloy and the surface of the rolls due to the large rolling reduction of about 20% to 25%. However, with magnesium alloys, such level of rolling reduction is not suitable as it will introduce surface defects, such as surface cracking. However, achieving a convex meniscus maintains an optimised contact of molten magnesium alloy with each roll, and establishes a uniform solidification front enabling sufficiently rapid solidification. The convex menisci are achieved by the substantial melt head required by the present invention, while the contact between the alloy and the rolls still is enhanced by the lower level of rolling reduction necessary to avoid surface defects, such as cracks. With aluminium alloys, the high level of rolling reduction and small, if any, melt head substantially preclude convex menisci, and produce menisci which are concave or vary between concave and convex.

With the rapid solidification enabled by the present invention for the production of magnesium alloy strip, it is found that a number of practical benefits are able to be achieved. Thus, the strip can have a microstructure having the secondary dendritic arm spacing of primary magnesium refined to about 5 to 15 μm, compared with 25 to 100 μm for magnesium alloy microstructures resulting from conventional casting technologies. This refinement leads to uniform distribution of intermetallic secondary phases, thereby facilitating improvement in mechanical properties by cold working of the strip.

Also, the rapid solidification refines the size of particles of intermetallic secondary phases to about 1 μm, compared to up to 25 to 50 μm for magnesium alloy microstructures from conventional casting technologies. This refinement minimises crack initiation around those particles, further facilitating improvement in mechanical properties by cold working of the strip.

Moreover, the rapid solidification can be controlled for achieving equi-axed growth of alpha magnesium dendrites across the thickness of strip being formed, by variation in the cooling rate from initial to final solidification through to the middle of the strip thickness. This, together with melt treatment such as grain refining, minimizes detrimental centre-line segregation, while maintaining the integrity of the as-cast magnesium alloy strip. This is not an issue in the twin roll casting of aluminium alloys as the alpha aluminium dendrites are always columnar-like, as there is no segregation problems for these alloys.

Additionally, the magnesium alloy strip produced by the present invention is well suited to processing for controlling its microstructure and properties. Thus, hot rolling and final heat treatment can be carried out on the as-cast strip to refine the microstructure and enhance the mechanical properties of resultant final gauges. Typical requirements for a range of applications necessitate the refinement of primary magnesium grain size and substantially uniform properties in both longitudinal and transverse directions. We have established that one or two longitudinal cold rolling passes, followed by suitable heat treatment, can refine the primary magnesium grains by recrystallization. Also, applying controlled transverse strain and suitable heat treatment, both after one or two longitudinal cold rolling passes, enables refinement of primary magnesium grains, as well as substantially uniform transverse and longitudinal mechanical properties.

As to operating costs, it will be appreciated that the ability to achieve stable solidification and establishment of production within a few minutes is particularly significant. Establishing stable thermal distributions is of importance in this regard. Sufficient magnesium melt protection during the production of strip reduces the preparation time between operations, and allows cost-effective small and medium sized operation.

In order that the invention may more readily be understood, reference now is directed to the accompanying drawings, in which:

FIGS. 4 and 5 show in side elevation and partial plan view, respectively, a nozzle/roll arrangement for the installation of FIG. 1;

Figure 10:
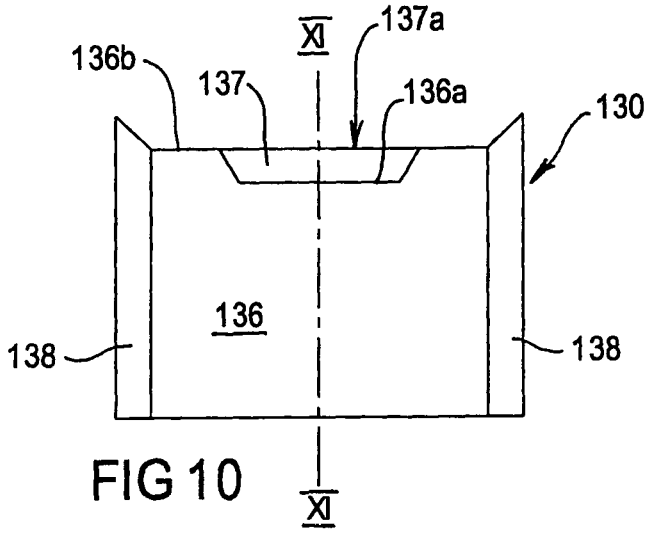
FIG. 10 shows an improved form of nozzle suitable for use in the present invention.
Figure 12:
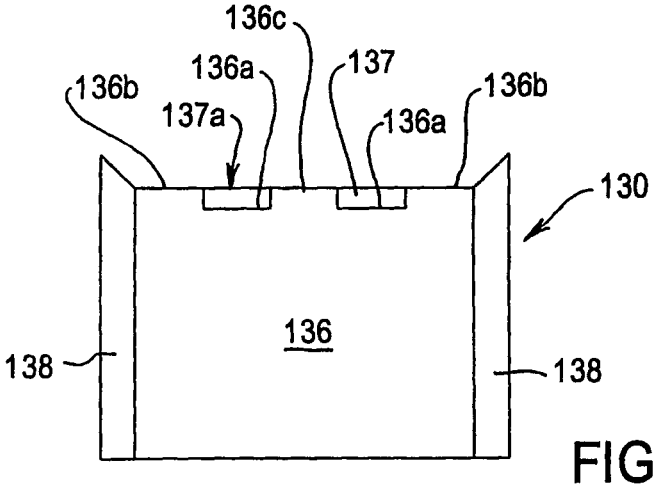

FIG. 12 corresponds to FIG. 10, but shows an alternative form of nozzle.

Figure 1:
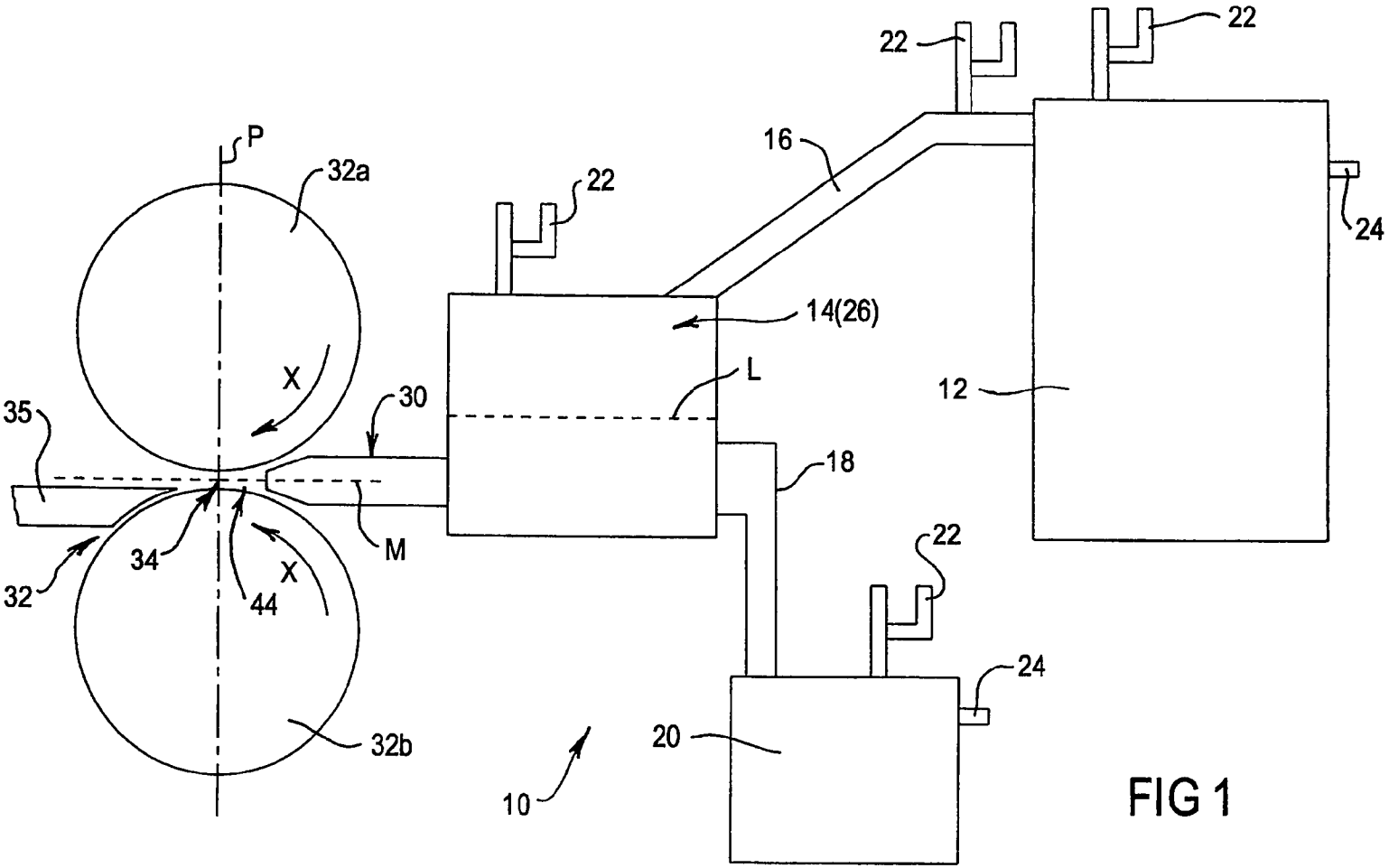
FIG. 1 is a schematic representation of a twin roll casting installation for use in the present invention.

In the schematic representation of FIG. 1, the installation 10 has a furnace 12 for maintaining a supply of molten magnesium alloy, and a tundish enclosure 14. The alloy is able to flow as required from furnace 12 to tundish enclosure 14 via transfer supply tube 16 under an arrangement operable to maintain a substantially constant head of alloy in enclosure 14. Overflow alloy is able to flow from enclosure 14 via tube 18, for collection in container 20. For each of furnace 10, enclosure 14, container 20 and tube 16, there is a respective inlet connector 22 by which a gas, for maintaining a protective atmosphere as detailed earlier herein, is able to be supplied from a suitable source (not shown). Each of furnace 12 and container 20 has an outlet connector 24 by which the gas is able to discharge for flow to a recovery vessel (not shown).

Figure 2:
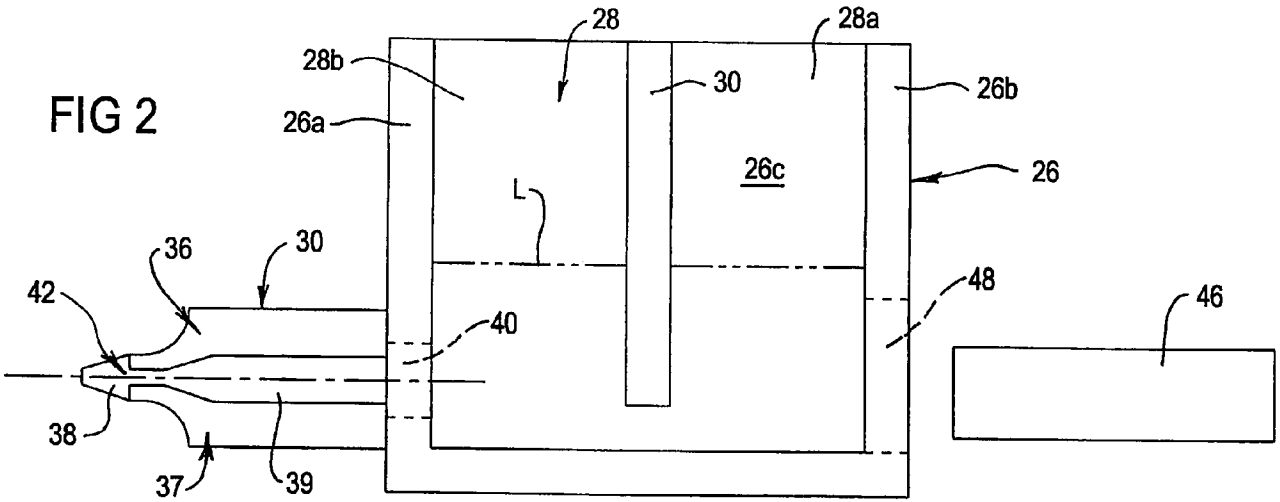
FIGS. 2 and 3 show in side sectional view and plan view, respectively, a tundish/nozzle arrangement for the installation of FIG. 1.
Figure 3:
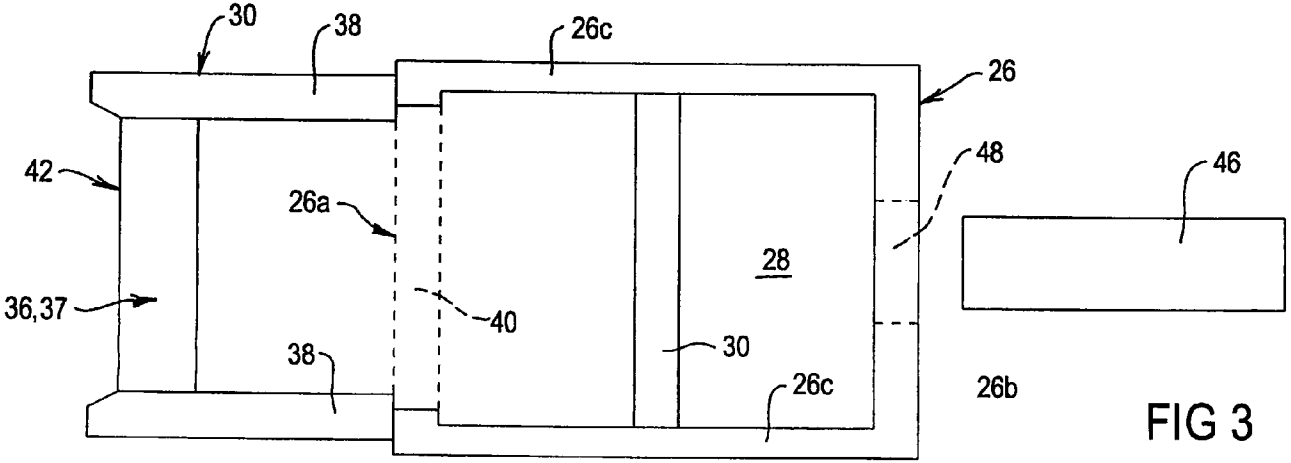

A form of tundish 26 for enclosure 14 is shown in FIGS. 2 and 3. Tundish 26 has front and rear walls 26*a* and 26*b*, side walls 26*c* and a base 26*d* which together define a chamber 28. Tundish 26 also has a cover (not shown) and a transverse baffle 30 which extends between walls 26*c* but has its lower edge spaced from base 26*d*. Baffle 30 thus divides chamber 28 into a rear portion 28*a* and a forward portion 28*b*.

Installation 10 also includes a nozzle 30 and a roll arrangement 32. Nozzle 30 extends forwardly from wall 26*a* of tundish 26, and into a gap between upper and lower rolls 32*a* and 32*b* of arrangement 32. The rolls 32*a*, 32*b* extend horizontally and are vertically spaced to define a bite or nip 34 therebetween. Arrangement 32 also includes an exit table or conveyor 35 on the side of rolls 32*a*,32*b* remote from nozzle 30.

The arrangement of FIGS. 2 and 3 and that of FIGS. 4 and 5 show alternative forms of nozzle 30. Corresponding parts of these have the same reference numeral. In each case, the nozzle 30 has horizontally disposed, vertically spaced upper and lower plates 36 and 37 and opposite side plates 38. An alloy flow cavity 39 extends through nozzle 30 and is defined by horizontal plates 36,37 and side plates 38. Alloy in tundish 26 is able to flow into nozzle 30 through an opening 40 in the front wall 26*a* of tundish 26, with alloy able to discharge between rolls 32*a*,32*b* from an elongate outlet 42 along the edge of plates 36,37 remote from tundish 26. As seen most clearly in FIGS. 2 and 4, plates 36,37 and side plate 38 are tapered so as to be able to extend close to each of rolls 32*a*,32*b*. However, outlet 42 is set back from a plane P containing the axes of rolls 32*a*,32*b* such that a chamber 44 is defined between nozzle 30 and rolls 32*a*,32*b*.

With use of installation 10, tundish 26 and nozzle 30 initially are pre-heated to temperature levels detailed earlier herein. For this purpose, a hot air gun 46 (shown in FIGS. 2 and 3) is able to be inserted into an opening 48 in rear wall 26*b* of tundish 26. When those temperature levels are achieved, gun 46 is retracted and opening 48 is closed. Molten alloy then is caused to flow from furnace 12, along tube 16 and into tundish 26. Alloy in tundish 26 is maintained at a required level, shown by broken line L in FIGS. 1 and 2, above a horizontal plane represented by line M through the centre of nozzle outlet 42 and the bite or nip 34 of rolls 32*a*,32*b*. The molten alloy is protected by maintaining a suitable atmosphere as detailed earlier herein, with the gas for providing this being supplied to connectors 22. The atmosphere is maintained at a pressure slightly above atmospheric pressure, with over-flow gas being collected from connectors 24.

Figure 9:
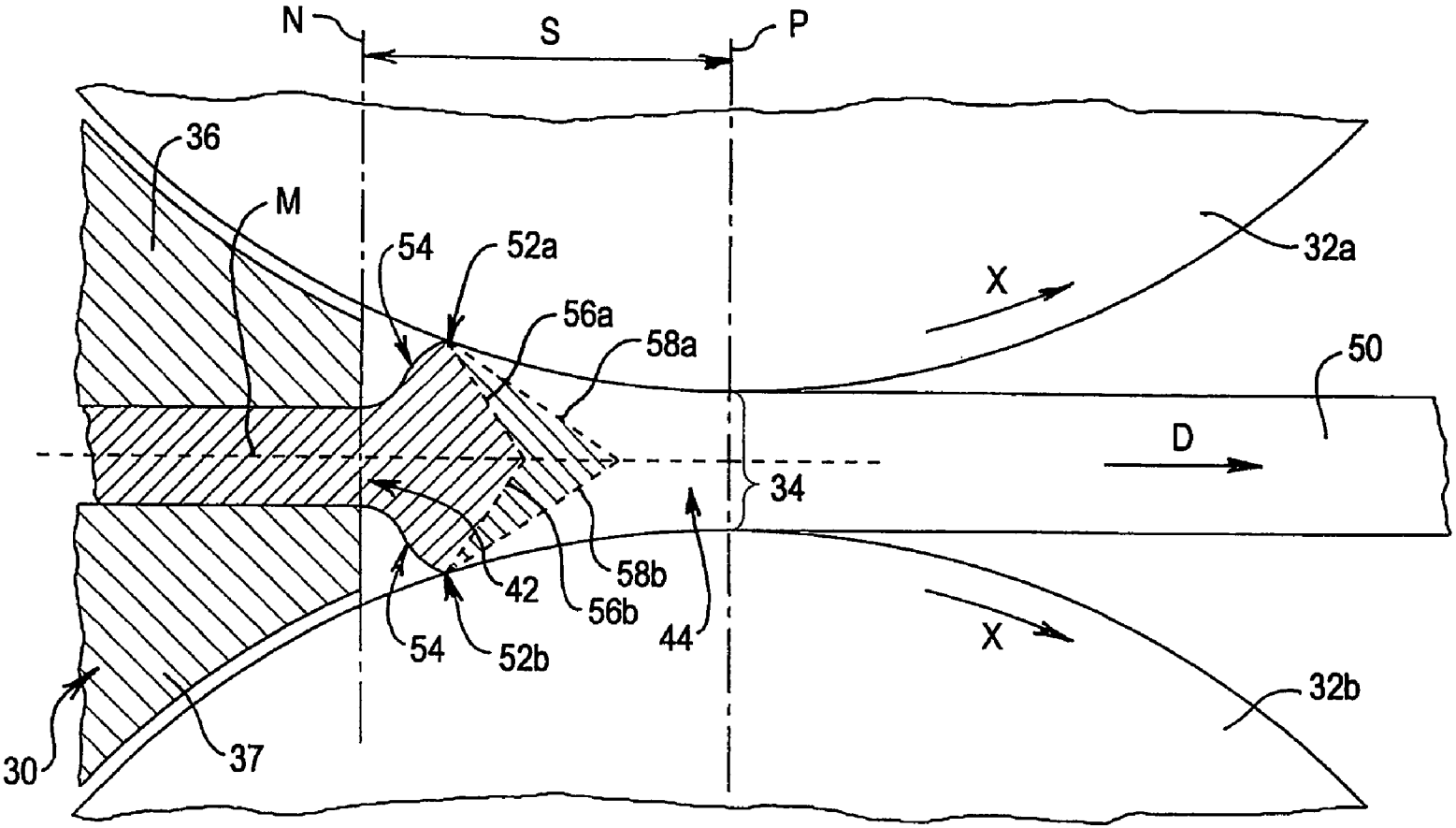
FIG. 9 shows on an enlarged scale details relating to magnesium alloy solidification in use of an installation as in FIG. 1.

From tundish 26, the alloy flows at a controlled rate through opening 40 to cavity 39 of nozzle 30. From cavity 39, the alloy discharges through the length of outlet 42, into chamber 44, and then through the bite or nip 34 between rolls 32*a*,32*b*. The rolls 32*a*,32*b* are internally water-cooled and rotated in unison in the respective directions shown by arrows X. The molten alloy progressively solidifies in chamber 44 due to the cooling effect of rolls 32*a*,32*b*, to form magnesium alloy strip 50 (as shown in FIG. 9) which passes along table 35. As shown in FIGS. 4 and 5, table 35 may have openings 35*a* adjacent to its edge nearer to rolls 32*a*,32*b*, through which pressurised gas is able to be supplied against the lower surface of the strip 50, to further cool the strip and assist its movement onto table 35.

Figure 6:
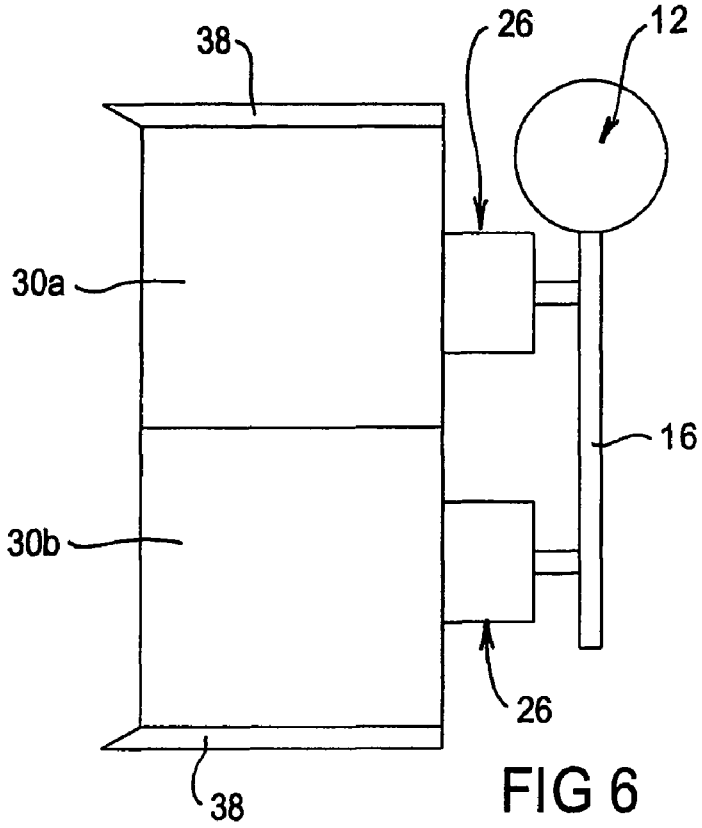
FIGS. 6 to 8 show alternative modular nozzle arrangements suitable for an installation as in FIG. 1.
Figure 7:
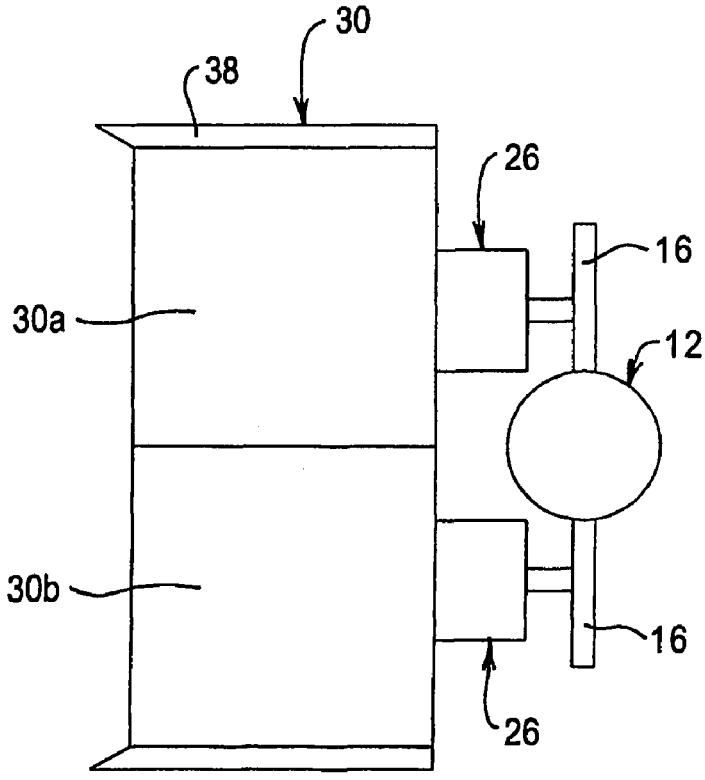

FIGS. 6 and 7 show alternative arrangements in which plates 36,37 of nozzle 30 are provided by two similar modules 30*a* and 30*b*. Each module is able to receive molten alloy from a respective tundish 26, with each tundish receiving alloy from a furnace 12 via a common tube 16 (FIG. 6) or a respective tube 16 (FIG. 7).

Figure 8:
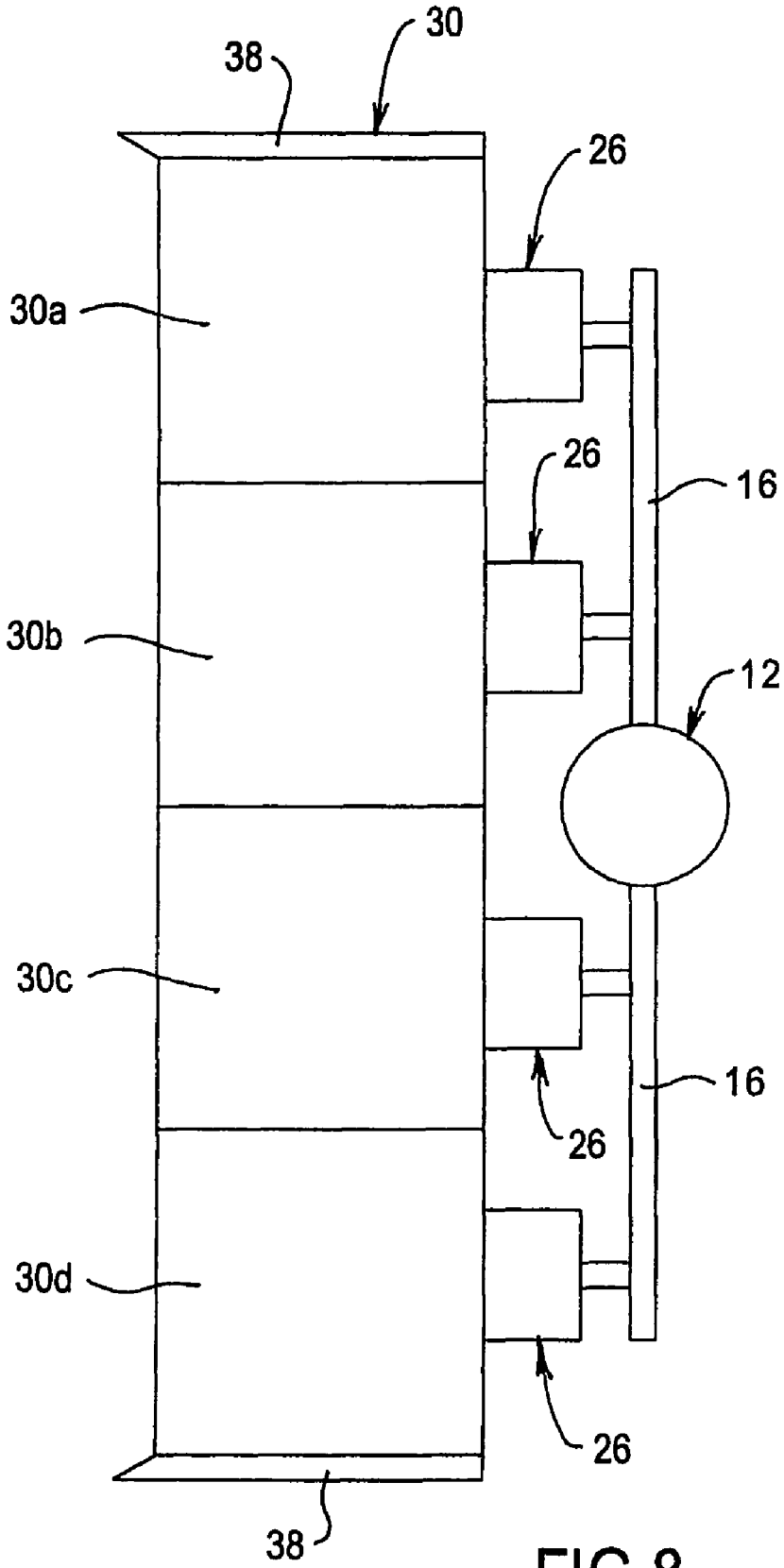

FIG. 8 is similar to FIG. 6. However, rather than one pair of modules receiving alloy via a common tube 16, there are two pairs of modules, with each pair having a respective tube 16 common to its modules.

Turning now to FIG. 9, the planes P and M are shown. The spacing S between plane P and a plane N parallel to plane P and extending across outlet 42 of nozzle 30, defines the horizontal extent of chamber 44. That spacing is referred to as the set-back, while the height of line L (see FIGS. 1 and 2), above plane M is referred to as the melt head. As detailed earlier herein, the set-back, the melt head, the speed of rotation of rolls 32*a* and 32*b* and the load applied by rolls 32*a*,32*b* to the alloy are controlled to achieve a required alloy flow rate for a given roll diameter. These parameters and the rate of heat energy extraction from the alloy are controlled so that, between outlet 42 and its respective contact at 52*a*,52*b* along each of rolls 32*a*,32*b*, the molten alloy establishes a convex meniscus as shown at 54. Throughout its contact with each roll 32*a*,32*b*, from lines of contact 52*a*,52*b*, the alloy is fully solidified at its surface. However, upstream of lines 56*a*,56*b*, the alloy is substantially fully molten, while downstream of lines 58*a*,58*b*, the alloy is substantially fully solidified, and between the two sets of lines the alloy is only partially solidified. The relative rates at which the lines of each set converge in the direction D of alloy/strip movement, determine the rate at which alloy solidifies from its surface against each of rolls 32*a*,32*b* through to plane M. The point of convergence of lines 58*a*,58*b* on about plane M represents substantially full solidification and, as detailed earlier herein, this is to be attained in advance of the alloy reaching bite or nip 34 (i.e. plane P).

Figure 11:
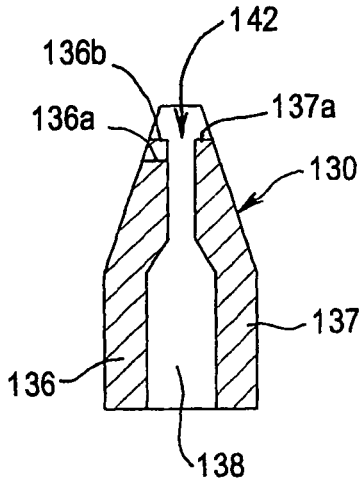
FIG. 11 is a sectional view, taken on line XI—XI of FIG. 10.

FIGS. 10 and 11 show a nozzle 130 having a top plate 136, a bottom plate 137 and side plates 138. At their forward edges, plates define an elongate nozzle outlet 142. The lower plate 137 has a forward edge 137*a* which extends linearly between plates 138. In a normal arrangement, top plate 136 would have a corresponding edge, but strip cast with such normal arrangement would have a central region which is hotter than edge regions. To avoid this, top plate 136 has an edge which has a central region 136*a* which is recessed rearwardly from respective edge regions 136*b* thereof. This arrangement, as detailed earlier herein, enables temperature variation across the width of cast strip to be reduced, with adverse consequences of the variation reduced or avoided.

The arrangement of FIG. 12 will be understood from the description of FIGS. 10 and 11. In this instance, the forward edge of top plate 136 is set back at two central regions 136*a* between edge regions 136*b*, with there being a mid-region 136*c* between the two regions 136*a*. This arrangement is suitable where more complex temperature variation results from internal spacers between plates 136,137. In the case of FIG. 11, there may be two central spacers, tending to cause two central hot zones separated by a mid-zone intermediate in temperature between the hot zones and the cooler edge zones.

Finally, it is to be understood that various alterations, modifications and/or additions may be introduced into the constructions and arrangements of parts previously described without departing from the spirit or ambit of the invention.

The invention claimed is:

1. A process for the production of magnesium alloy strip, by twin roll casting, wherein the process includes the steps of:

(a) passing molten alloy from a source of supply to a feeding device;

(b) feeding molten alloy from the feeding device through a nozzle to a chamber formed between an elongate outlet of the nozzle and a pair of substantially parallel rolls which are spaced one above the other to define a bite therebetween;

(c) rotating said rolls in opposite directions whereby alloy is drawn from the chamber through the bite simultaneously with the feeding of step (b); and (d) flowing coolant fluid through each roll during the rotating step (c) to provide internal cooling of the rolls and thereby cooling alloy received in the chamber by heat energy extraction by the cooled rolls whereby substantially complete solidification of the magnesium alloy is achieved in the chamber prior to alloy passing through the bite defined between rolls and issuing therefrom as hot rolled alloy strip; and wherein the process further includes:

maintaining alloy held at the source at a temperature sufficient to maintain alloy in the feed device at a superheated temperature above its liquidus temperature for the alloy;

maintaining a depth of molten alloy in the feed device at a sufficient, controlled, substantially constant height of molten alloy above a centreline of the bite in a plane containing the axes of the rolls; and maintaining heat energy extraction by the cooled rolls in step (c) at a level sufficient to maintain alloy strip issuing from the bite at a surface temperature below about 400° C.;

whereby the hot rolled alloy strip is substantially free of cracks and has good surface quality.

2. The process of claim 1, wherein the alloy held at the source is at a temperature sufficient to maintain alloy in the feed device at a temperature of from about 15° C. to about 60° C. above the liquidus temperature for the alloy.

3. The process of claim 1, wherein the level of heat energy extracted in cooling step (c) is sufficient to maintain said surface temperature substantially below 400° C.

4. The process of claim 1, wherein the level of heat energy extraction in step (c) is sufficient to maintain said surface temperature at from about 180° C. to about 300° C.

5. The process of claim 3, wherein said surface temperature is not less than about 85° C. below the solidus temperature for the alloy.

6. The process of claim 1, wherein said rolls apply a specific load to solidified alloy passing through the bite of from about 2 to about 500 kg. per mm of roll length.

7. The process of claim 6, wherein the specific load is from about 100 to about 500 kg. per mm of roll length.

8. The process of claim 6, wherein the specific load applied results in a thickness reduction in the hot rolled strip of from about 4% to 9%.

9. The process of claim 1, wherein over an initial part of a setback distance from the outlet of the nozzle to the plane containing the axes of the rolls, the alloy maintains a respective convex meniscus between the outlet of the nozzle and the surface of each roll.

10. The process of claim 9, wherein each meniscus extends from the outlet of the nozzle by up to about 35% of said setback distance.

11. The process of claim 10, wherein each meniscus extends from the outlet of the nozzle by from 10% to 30% of the setback distance.

12. The process of claim 1, wherein full solidification between upper and lower surfaces of the alloy is achieved in advance of the final 5% to 15% of the setback distance from the outlet of the nozzle to said plane containing the axes of the rolls.

13. The process of claim 1, wherein prior to step (a), each of the feed device and nozzle is preheated close to a required operating temperature.

14. The process of claim 13, wherein the preheating is achieved by blowing hot air through the feed device and the nozzle.

15. The process of claim 13, wherein the feed device is preheated to a temperature of from about 500° C. to about 655° C., and the nozzle is preheated to a temperature of from about 200° C. to 400° C.

16. The process of any claim 1, wherein in the feeding step (b) the alloy is fed from a central region of the outlet of the nozzle which is a slight distance upstream, relative to the direction of alloy flow through the nozzle, with respect to alloy feed from laterally outer regions of the outlet, whereby variation in temperature across the width of the hot rolled strip is reduced or substantially eliminated.

17. The process of claim 16, wherein said slight distance is less than about 7 mm.

18. The process of claim 1, wherein a protective atmosphere is maintained over molten alloy to safeguard against oxidation and risk of fire, and wherein the atmosphere includes a minor proportion of a suitable hydrofluorocarbon.

19. The process of claim 18, wherein the hydrofluorocarbon is 1,1,1,2-tetrafluoroethane.

20. The process of claim 18, wherein the hydrofluorocarbon is present in the atmosphere at from about 2 to 6 volume %.

21. The process of claim 18, wherein the atmosphere in which the hydrofluorocarbon is provided comprises a $SF_6$/dry air mixture.

22. The process of claim 1, wherein said step of maintaining the depth of molten alloy in the feed device provides a substantially constant height of molten alloy above the centreline of the bite of from about 5 mm to about 22 mm.

23. The process of claim 22, wherein the alloy has a lower level of alloy element addition and said substantially constant height is from 5 mm to 10 mm.

24. The process of claim 22, wherein said alloy has a higher level of alloy element addition and said substantially constant height is from 7 mm to 22 mm.

* * * * *